US012317994B1

(12) United States Patent
Zhang

(10) Patent No.: US 12,317,994 B1
(45) Date of Patent: Jun. 3, 2025

(54) COMBINED DESK TOP

(71) Applicant: Siyu Zhang, Shenzhen (CN)

(72) Inventor: Siyu Zhang, Shenzhen (CN)

( * ) Notice: Subject to any disclaimer, the term of this patent is extended or adjusted under 35 U.S.C. 154(b) by 0 days.

(21) Appl. No.: 18/947,571

(22) Filed: Nov. 14, 2024

(30) Foreign Application Priority Data

Oct. 18, 2024 (CN) ..... 202422519957.9

(51) Int. Cl.
*A47B 19/06* (2006.01)
*A47B 13/08* (2006.01)
*A47B 13/16* (2006.01)
*A47B 19/10* (2006.01)

(52) U.S. Cl.
CPC ..... *A47B 19/06* (2013.01); *A47B 13/088* (2013.01); *A47B 13/16* (2013.01); *A47B 19/10* (2013.01)

(58) Field of Classification Search
CPC ..... A47B 19/06; A47B 19/08; A47B 19/10; A47B 13/088; A47B 13/16
USPC ..... 108/3, 43, 45, 180, 190; 248/454, 455, 248/456
See application file for complete search history.

(56) References Cited

U.S. PATENT DOCUMENTS 421,101 A * 2/1890 Manheimer ..... A45D 24/16 248/463
757,202 A * 4/1904 Kinman ..... A47B 19/06 248/447.2
889,982 A * 6/1908 Steinberg ..... A47B 23/043 248/456
1,203,659 A * 11/1916 Smith ..... A47B 23/043 248/456
2,848,290 A * 8/1958 Doty ..... A47B 23/046 108/4
3,376,009 A * 4/1968 Domino ..... A47B 23/043 248/456
4,053,133 A * 10/1977 Kauffman ..... B60R 7/08 248/452
4,518,140 A * 5/1985 Ferranto ..... B44D 3/18 248/456
4,700,634 A * 10/1987 Mills ..... B43L 13/005 248/444
4,842,174 A * 6/1989 Sheppard ..... F16M 13/02 224/567
4,978,096 A * 12/1990 Struckmann ..... A47B 23/043 248/451

(Continued)

FOREIGN PATENT DOCUMENTS

CN 202504569 U 10/2012
CN 216438827 U 5/2022
CN 116530777 A 8/2023

*Primary Examiner* — Jose V Chen
(74) *Attorney, Agent, or Firm* — George D. Morgan

(57) ABSTRACT

The utility model provides a combined desk top and relates to the technical field of desks. The combined desk top includes a book stand, a placing plate, and a combined support frame. The combined support frame includes a U-shaped left support frame and a U-shaped right support frame, the book stand is rotatably connected above the left support frame by using a hinge, the placing plate is fixed above the right support frame by using a screw, each of two front and rear ends of one side of the left support frame is provided with a waist-shaped hole, an inserting member is fixedly connected to one side of the right support frame correspondingly, the inserting member is provided with a fixing hole, the inserting member is inserted into the left support frame.

7 Claims, 7 Drawing Sheets

(56) References Cited

U.S. PATENT DOCUMENTS

| | | | | | |
|---|---|---|---|---|---|
| 5,460,102 | A * | 10/1995 | Pasmanick | A47B 23/002 | 108/43 |
| 5,979,337 | A * | 11/1999 | Clark | A47B 23/002 | 248/444 |
| 7,770,864 | B2 * | 8/2010 | Phifer | A47B 23/043 | 248/455 |
| 8,322,292 | B2 * | 12/2012 | Chen | A47B 23/043 | 248/463 |
| 8,424,465 | B2 * | 4/2013 | Florendo, Jr. | A47B 23/043 | 248/456 |
| 2008/0149801 | A1 * | 6/2008 | Wood | A47B 23/043 | 248/456 |
| 2010/0044543 | A1 * | 2/2010 | Ramey, III | A47B 21/045 | 248/456 |
| 2014/0373758 | A1 * | 12/2014 | Pajic | B64D 11/0624 | 108/3 |
| 2015/0034793 | A1 * | 2/2015 | Roth | A47B 19/06 | 248/456 |
| 2015/0257528 | A1 * | 9/2015 | Rosing | A47B 23/046 | 108/3 |
| 2018/0125233 | A1 * | 5/2018 | Leier | A47B 13/088 | |
| 2023/0293979 | A1 * | 9/2023 | Che | A47B 19/08 | 108/59 |
| 2024/0074578 | A1 * | 3/2024 | Bergmann | A47B 85/02 | |

* cited by examiner

COMBINED DESK TOP

CROSS-REFERENCE TO RELATED APPLICATIONS

The application claims priority to Chinese patent application No. 2024225199579, filed on Oct. 18, 2024, the entire contents of which are incorporated herein by reference.

TECHNICAL FIELD

The utility model relates to the technical field of desks, and in particular, to a combined desk top.

BACKGROUND

Desks are widely used in people's daily life and study. For example, a bed desk can allow a notebook computer, a book, or the like to be placed on a bed and to be used, and desk legs can be folded, so that use is convenient and an occupied area is small; and a mobile desk is convenient to move and use. Existing desk tops of the bed desk, the mobile desk, and the like generally adopt an integrated mounting structure. Although some desks can implement folding of desk legs to reduce space occupation, due to a large overall layout of the desk top, a larger packaging box needs to be occupied, thereby increasing transportation costs. In particular, when cross-border transportation is involved, the transportation costs are higher. Therefore, a combined desk top is designed, to facilitate splitting, stacking, packaging, and transporting the desk top and reduce the transportation costs, and assembly is convenient.

SUMMARY

In view of deficiencies in the prior art, the utility model provides a combined desk top. The design of a combined support frame structure is adopted, to facilitate disassembling, stacking, packaging, and transporting the desk top and reduce transportation costs, and assembly is convenient.

To achieve the above purpose, the utility model adopts the following technical solutions:

A combined desk top includes a book stand, a placing plate, and a combined support frame, where the combined support frame includes a U-shaped left support frame and a U-shaped right support frame, the book stand is connected above the left support frame, the placing plate is fixed above the right support frame by using a screw, each of two front and rear ends of one side, close to the right support frame, of the left support frame is provided with a waist-shaped hole, an inserting member is fixedly connected to one side, close to the left support frame, of the right support frame correspondingly, the inserting member is provided with a fixing hole, the inserting member is inserted into the left support frame, and a screw is used to sequentially penetrate through the waist-shaped hole and the fixing hole to fix the left support frame and the right support frame to form the combined support frame.

As a preferred solution of the utility model, one side of the book stand is rotatably connected to the left support frame by using a hinge, a rotating connection member is fixedly connected to a middle portion of a lower end surface of the book stand, an adjusting member is rotatably connected in the rotating connection member, an adjusting limiting tooth is fixedly connected to the left support frame correspondingly, and the adjusting member is rotated to be located between adjusting limiting teeth that are at different positions, to adjust an angle between the book stand and the combined support frame.

As a preferred solution of the utility model, the adjusting member adopts a rectangle-like frame structure, two opposite edges of the frame structure are adopted, one edge is placed in the rotating connection member, and the other edge is matched with the adjusting limiting tooth in a limiting manner.

As a preferred solution of the utility model, a support block is disposed on a top portion of one side, close to the hinge, of the book stand, and an anti-skid pad is fixedly connected to a top portion of the support block.

The technical effects of using the above further solutions are as follows: a book, a tablet computer, a notebook computer, and the like may be placed on the support block, to limit a placement object, and the anti-skid pad plays a role of skidding and scraping prevention.

As a preferred solution of the utility model, the placing plate is provided with a through hole, a cup holder is clamped in the through hole, a limiting ring is disposed at an upper end of the cup holder, an outer diameter of the limiting ring is greater than an inner diameter of the through hole, a clasp is disposed on a bottom portion of the cup holder, and the clasp is clamped on a bottom portion of the through hole.

As a preferred solution of the utility model, a corner of the placing plate is provided with a threaded connection hole for expansion and connection.

As a preferred solution of the utility model, a support bracket is threadedly connected in the threaded connection hole, the support bracket includes a threaded column that is threadedly connected and fixed to the threaded connection hole, an upper end of the threaded column is a connecting column, an upper end of the connecting column is a steering corrugated pipe, and an upper end of the steering corrugated pipe is rotatably connected to a clamping device.

Compared with the prior art, beneficial effects of the utility model are as follows:

In the utility model, according to the design of the combined support frame structure, the book stand may be rotatably connected to the left support frame, and the placing plate may be fixedly connected to the right support frame. During packaging and transportation, the combined support frame may be disassembled. In this way, the left support frame and a connecting component connected thereon and the right support frame and a connecting component connected thereon may be stacked for packaging, to reduce packaging space occupation, that is, the disassembled combined desk top can be packaged and transported without a packaging box with a corresponding layout size after combination, to reduce packaging and transportation costs. In addition, the support block disposed at the upper end of the book stand is matched with the anti-skid pad, so that the book, the tablet computer, the notebook computer, and the like are limited and protected from skidding and scraping, thereby avoiding skidding and falling during rotation and adjustment of the book stand. The adjusting member, the rotating connection member, and the adjusting limiting tooth are matched with each other, so that an angle of the book stand may be adjusted as required, and use is convenient. According to the design of the cup holder, the water cup, the water bottle, and the like can be placed. According to the design of the threaded connection hole structure, apparatuses such as the mobile phone/tablet support bracket and the desk lamp may be expanded and connected, and a use function and the like thereof may be expanded.

REFERENCE NUMERALS IN THE DRAWINGS

Figure 1:
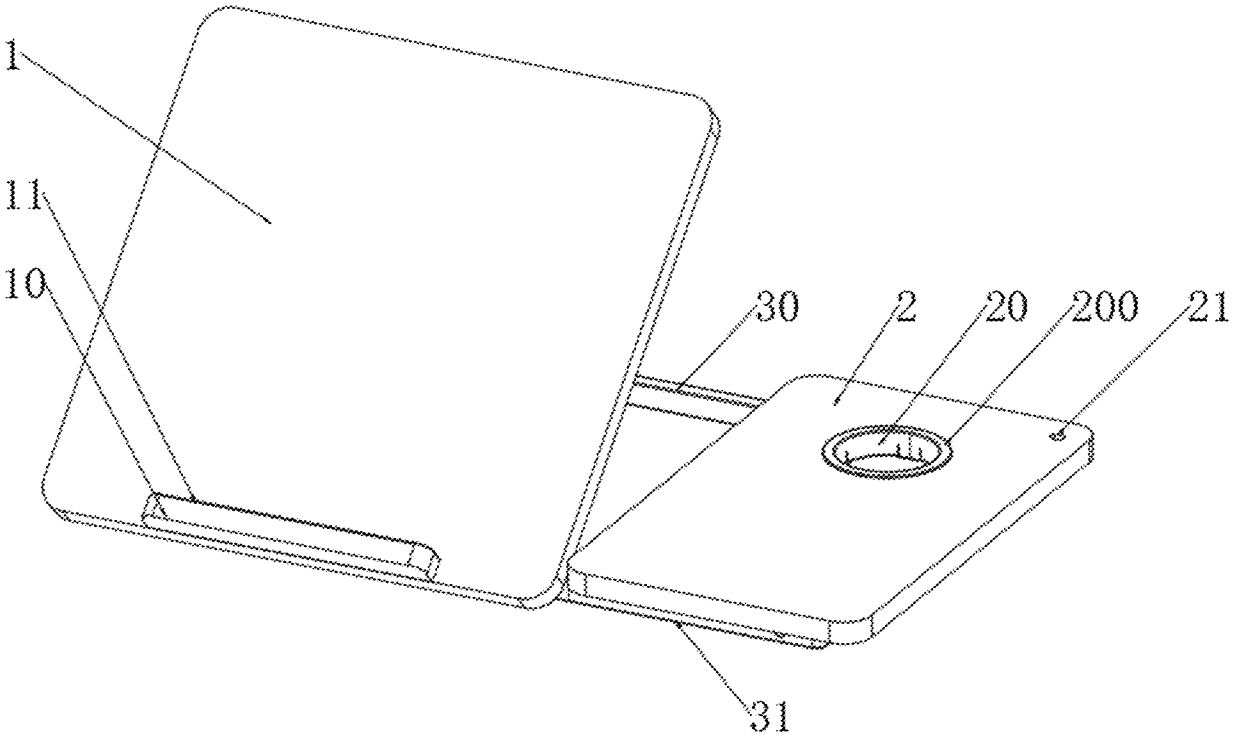
FIG. 1 is a schematic diagram 1 of an overall structure of a combined desk top according to the utility model.
Figure 2:
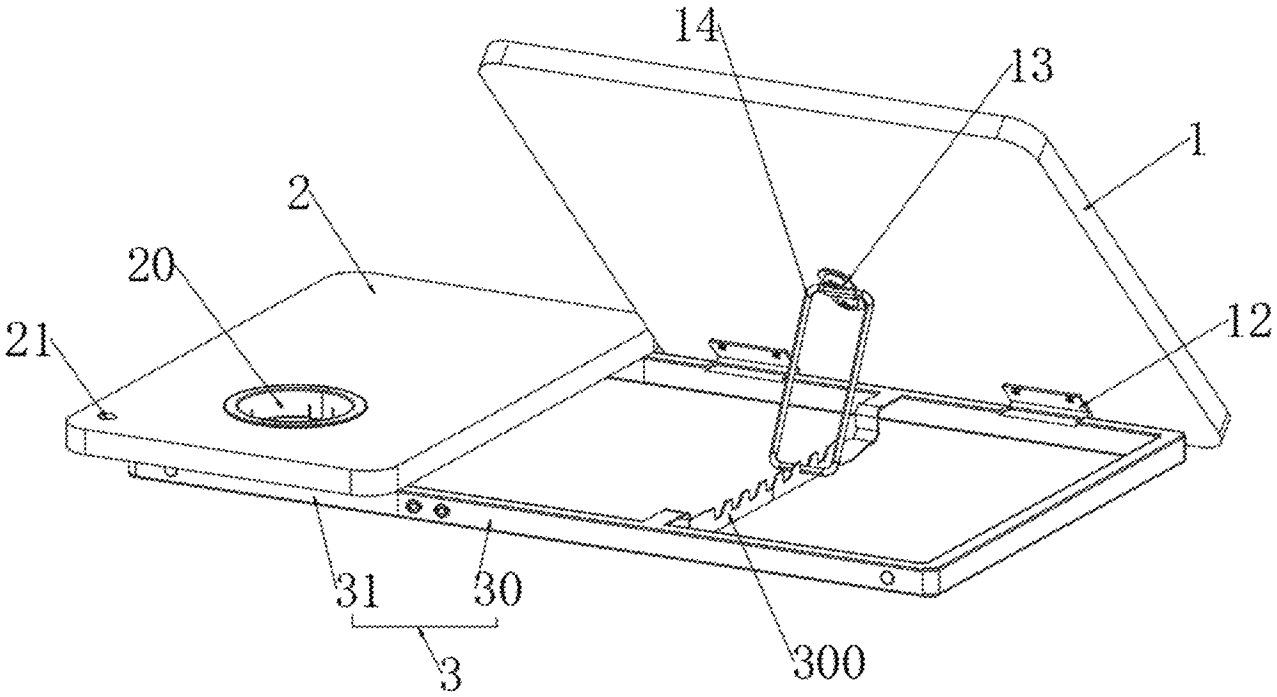
FIG. 2 is a schematic diagram 2 of an overall structure of a combined desk top according to the utility model.
Figure 3:
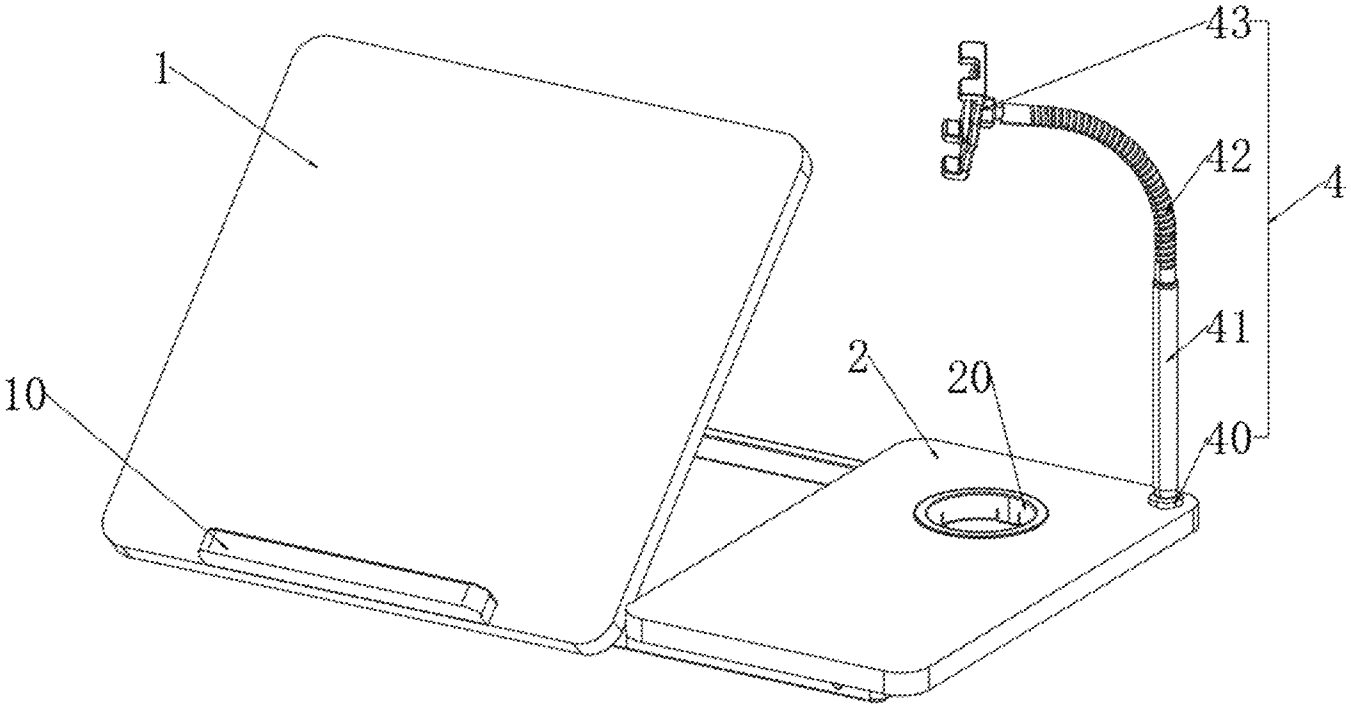
FIG. 3 is a schematic diagram 3 of an overall structure of a combined desk top according to the utility model.
Figure 4:
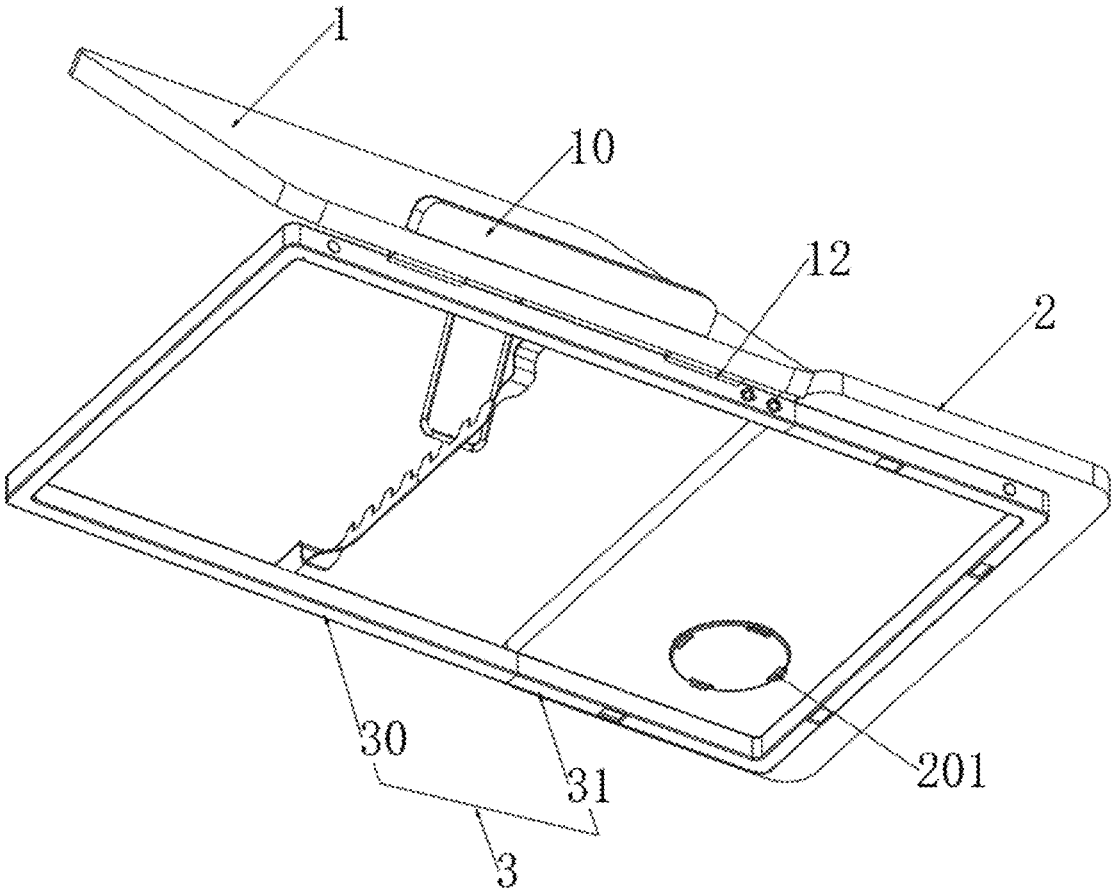
FIG. 4 is a schematic diagram 4 of an overall structure of a combined desk top according to the utility model.
Figure 5:
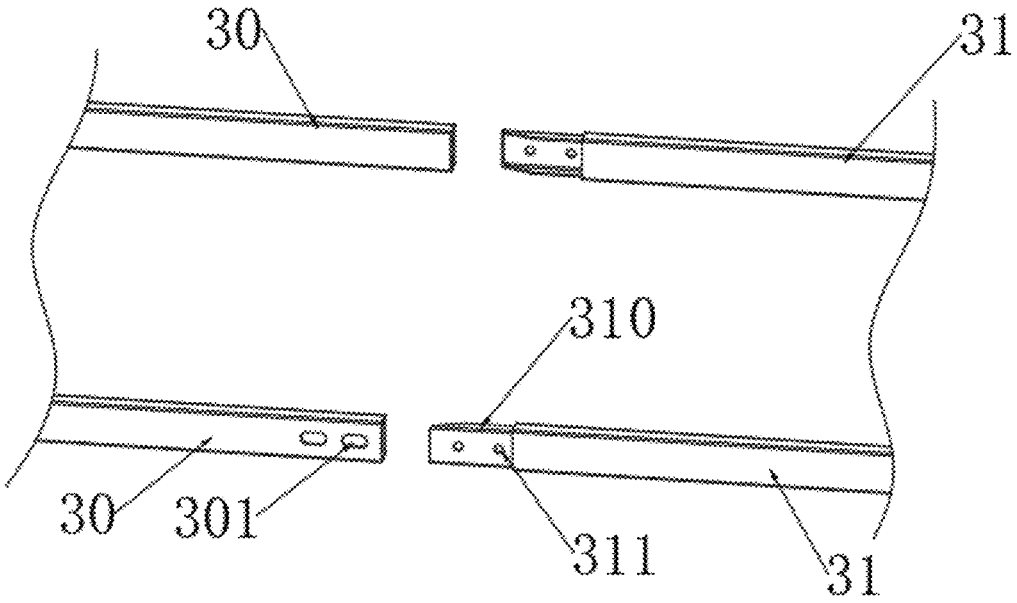
FIG. 5 is a schematic structural diagram of a combined support frame of a combined desk top according to the utility model.

1. book stand;

10. support block; 11. anti-skid pad; 12. hinge; 13. rotating connection member; 14. adjusting member;

2. placing plate;

20. cup holder; 200. limiting ring; 201. clasp; 21. threaded connection hole;

3. combined support frame;

30. left support frame; 300. adjusting limiting tooth; 301. waist-shaped hole; 31. right support frame; 310. inserting member; 311. fixing hole;

4. support bracket;

40. threaded column; 41. connecting column; 42. steering corrugated pipe; 43. clamping device.

DETAILED DESCRIPTION OF THE EMBODIMENTS

The following clearly and completely describes the technical solutions in the embodiments of the utility model with reference to the embodiments of the utility model. Apparently, the described embodiments are only some rather than all of the embodiments of the utility model. All other embodiments obtained by those of ordinary skill in the art based on the embodiments of the utility model without creative efforts shall fall within the protection scope of the utility model.

To facilitate understanding of the utility model, the utility model will be described more comprehensively below with reference to related accompanying drawings, and a plurality of embodiments of the utility model are provided. However, the utility model can be implemented in many different forms and is not limited to the embodiments described herein. On the contrary, an objective of providing these embodiments is to make the content disclosed in the utility model more thoroughly and comprehensively understood.

It should be noted that, when an element is described to be "fixedly disposed on" another element, it may be directly on another element or there may be a centered element. When an element is described to be "connected to" another element, it may be directly connected to another element or there may additionally be a centered element. The terms "vertical", "horizontal", "left", "right" and similar expressions in the specification are used for illustrative purposes only.

Unless otherwise defined, all technical and scientific terms used herein have the same meanings as those commonly understood by those of ordinary skill in the art to which the utility model belongs. The terms used in the specification of the utility model are merely for the purpose of describing specific embodiments, but are not intended to limit the utility model. The term "and/or" as used herein includes any and all combinations of one or more of the relevant listed items.

As shown in FIG. 1 to FIG. 5, the utility model provides a technical solution: a combined desk top includes a book stand 1, a placing plate 2, and a combined support frame 3. The combined support frame 3 includes a U-shaped left support frame 30 and a U-shaped right support frame 31, the book stand 1 is connected above the left support frame 30, the placing plate 2 is fixed above the right support frame 31 by using a screw, each of two front and rear ends of one side, close to the right support frame 31, of the left support frame 30 is provided with a waist-shaped hole 301, an inserting member 310 is fixedly connected to one side, close to the left support frame 30, of the right support frame 31 correspondingly, the inserting member 310 is provided with a fixing hole 311, the inserting member 310 is inserted into the left support frame 30, and a screw is used to sequentially penetrate through the waist-shaped hole 301 and the fixing hole 311 to fix the left support frame 30 and the right support frame 31 to form the combined support frame 3.

The combined desk top may be disassembled into two left and right parts by disassembling the combined support frame 3. During packaging and transportation, the two parts may be stacked and packaged, to reduce transportation costs and the like.

Further, one side of the book stand 1 is rotatably connected to the left support frame 30 by using a hinge 12, a rotating connection member 13 is fixedly connected to a middle portion of a lower end surface of the book stand 1, an adjusting member 14 is rotatably connected in the rotating connection member 13, and an adjusting limiting tooth 300 is fixedly connected to the left support frame 30 correspondingly. The adjusting member 14 is rotated to be located between adjusting limiting teeth 300 that are at different positions and is matched with the hinge 12 for rotation, to adjust an angle between the book stand 1 and the combined support frame 3. Therefore, this is adapted to people with different heights for use and is convenient to use.

In some embodiments, the adjusting member 14 adopts a rectangle-like frame structure, two opposite edges of the frame structure are adopted, one edge is placed in the rotating connection member 13, and the other edge is matched with the adjusting limiting tooth 300 in a limiting manner. Certainly, the adjusting member 14 may further adopt another shape of structure as long as one edge of the adjusting member can rotate with the rotating connection member 13, and the other edge thereof can be matched with the adjusting limiting tooth 300 in a limiting manner, which is not limited to the frame structure.

Further, a support block 10 is disposed on a top portion of one side, close to the hinge 12, of the book stand 1, and an anti-skid pad 11 is fixedly connected to a top portion of the support block 10.

According to the design of the support block 10 and the anti-skid pad 11, a book, a tablet computer, a notebook computer, and the like are limited and protected from skidding and scraping, thereby avoiding skidding and falling during rotation and adjustment of the book stand.

Further, the placing plate 2 is provided with a through hole, a cup holder 20 is clamped in the through hole, a limiting ring 200 is disposed at an upper end of the cup holder 20, an outer diameter of the limiting ring 200 is greater than an inner diameter of the through hole, a clasp 201 is disposed on a bottom portion of the cup holder 20, and the clasp 201 is clamped on a bottom portion of the through hole.

According to the design of a structure of the cup holder 20, a water cup, a water bottle, and the like can be placed, thereby avoiding toppling. The cup holder 20 is fixed on the placing plate 2 in a clamping manner, thereby facilitating replacing damaged and aged cup holders.

Further, a corner of the placing plate 2 is provided with a threaded connection hole 21 for expansion and connection. The threaded connection hole may be used for expansion and connection of structures such as a mobile phone/tablet support bracket and a desk lamp.

In some embodiments, a support bracket 4 is threadedly connected in the threaded connection hole 21, the support bracket 4 includes a threaded column 40 that is threadedly connected and fixed to the threaded connection hole 21, an upper end of the threaded column 40 is a connecting column 41, an upper end of the connecting column 41 is a steering corrugated pipe 41, and an upper end of the steering corrugated pipe 41 is rotatably connected to a clamping device 43. The clamping device 43 may be a mobile phone support bracket, a tablet support bracket, or the like with a universal steering ball, to clamp a mobile phone and a tablet.

Figure 6:
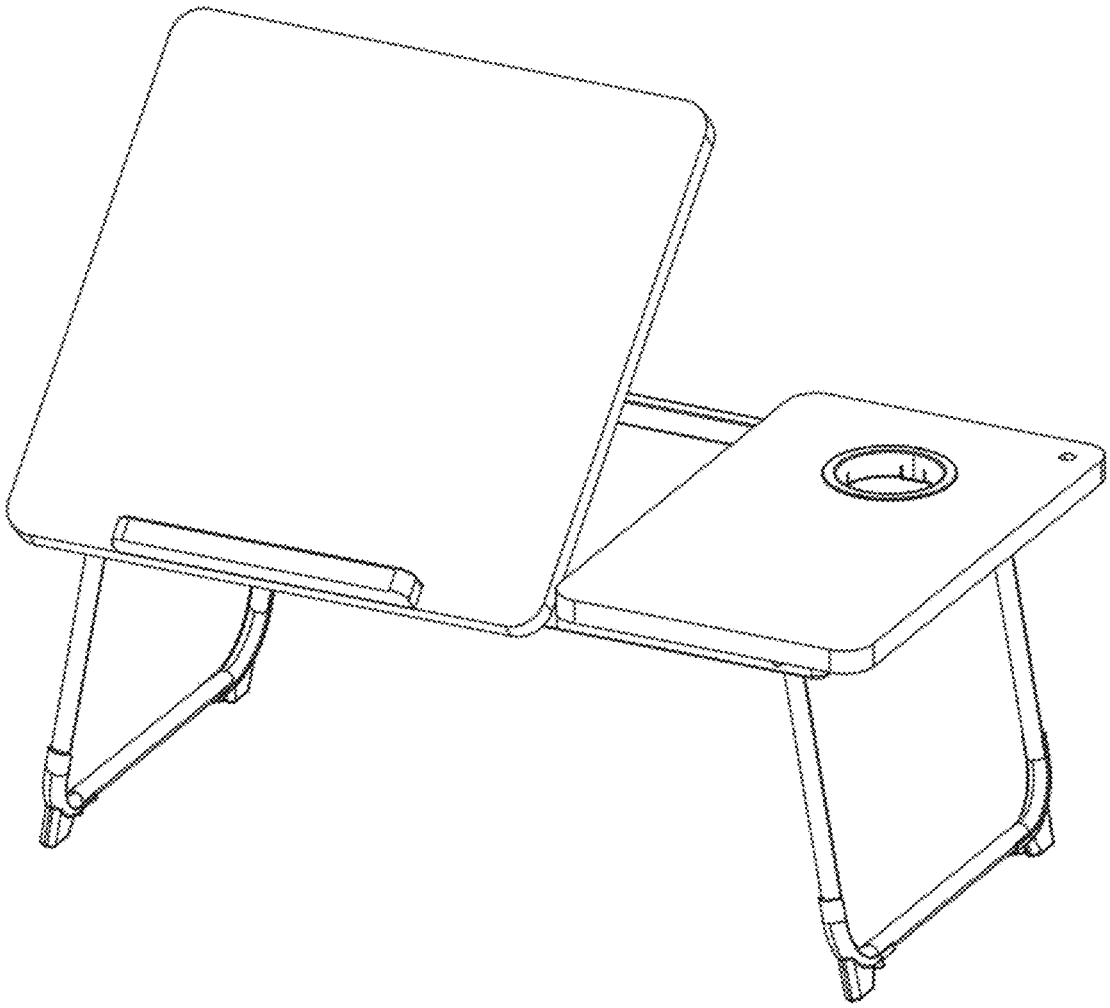
FIG. 6 is a use embodiment 1 of a combined desk top according to the utility model.
Figure 7:
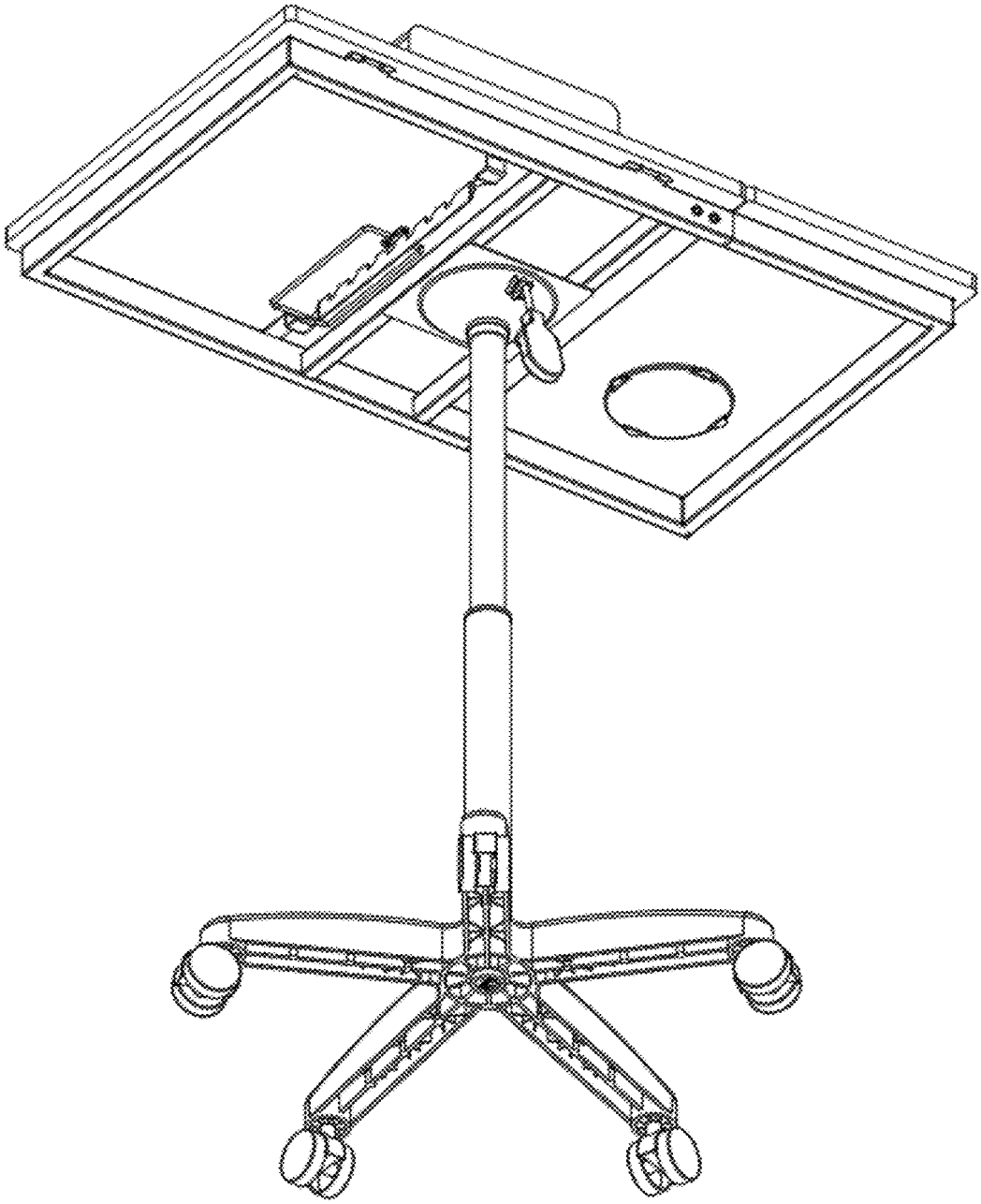
FIG. 7 is a use embodiment 2 of a combined desk top according to the utility model.

During specific use, as shown in FIG. 6, U-shaped support feet may be rotatably connected to inner sides of bottom portions of the left support frame 30 and the right support frame 31, to form a bed desk. As shown in FIG. 7, a mobile support foot may be fixed on a bottom portion of the combined desk top, to form a mobile desk. Certainly, the use of the combined desk top is not limited to the above two ways of use, which cannot be used to limit the protection scope of the utility model.

Although the embodiments of the utility model have been shown and described, it may be understood by those of ordinary skill in the art that, without departing from the principles and spirit of the utility model, various changes, modifications, replacements, and variations may be made to these embodiments, and the scope of the utility model is limited by the appended claims and equivalents thereof.

What is claimed is:

1. A combined desk top, comprising a book stand (1), a placing plate (2), and a combined support frame (3), wherein the combined support frame (3) comprises a U-shaped left support frame (30) and a U-shaped right support frame (31), the book stand (1) is disposed above the left support frame (30), the placing plate (2) is fixed above the right support frame (31) by using a screw, each of two front and rear ends of the left support frame (30) is hollow and provided with a waist-shaped hole (301), each of two front and rear ends of the right support frame (31) is fixedly connected with an inserting member (310), the inserting member (310) is provided with a fixing hole (311), the inserting member (310) is inserted into the left support frame (30) and the fixing hole (311) is aligned with the waist-shaped hole (301), and a screw is used to sequentially penetrate through the waist-shaped hole (301) and the fixing hole (311) to fix the left support frame (30) and the right support frame (31) to form the combined support frame (3).

2. The combined desk top according to claim 1, wherein one side of the book stand (1) is rotatably connected to the left support frame (30) by using a hinge (12), a rotating connection member (13) is fixedly connected to a middle portion of a lower end surface of the book stand (1), an adjusting member (14) is rotatably connected in the rotating connection member (13), an adjusting limiting tooth (300) is fixedly connected to the left support frame (30) correspondingly, and the adjusting member (14) is rotated to be located between adjusting limiting teeth (300) that are at different positions, to adjust an angle between the book stand (1) and the combined support frame (3).

3. The combined desk top according to claim 2, wherein the adjusting member (14) adopts a rectangle-like frame structure, two opposite edges of the frame structure are adopted, one edge is placed in the rotating connection member (13), and the other edge is matched with the adjusting limiting tooth (300) in a limiting manner.

4. The combined desk top according to claim 1, wherein a support block (10) is disposed on a top portion of one side, close to a hinge (12), of the book stand (1), and an anti-skid pad (11) is fixedly connected to a top portion of the support block (10).

5. The combined desk top according to claim 1, wherein the placing plate (2) is provided with a through hole, a cup holder (20) is clamped in the through hole, a limiting ring (200) is disposed at an upper end of the cup holder (20), an outer diameter of the limiting ring (200) is greater than an inner diameter of the through hole, a clasp (201) is disposed on a bottom portion of the cup holder (20), and the clasp (201) is clamped on a bottom portion of the through hole.

6. The combined desk top according to claim 1, wherein a corner of the placing plate (2) is provided with a threaded connection hole (21) for expansion and connection.

7. The combined desk top according to claim 6, wherein a support bracket (4) is threadedly connected in the threaded connection hole (21), the support bracket (4) comprises a threaded column (40) that is threadedly connected and fixed to the threaded connection hole (21), an upper end of the threaded column (40) is a connecting column (41), an upper end of the connecting column (41) is a steering corrugated pipe (42), and an upper end of the steering corrugated pipe (41) is rotatably connected to a clamping device (43).

* * * * *